United States Patent [19]

Ohlbach

[11] 4,160,503

[45] Jul. 10, 1979

[54] SHIPPING CONTAINER FOR PRINTED CIRCUIT BOARDS AND OTHER ITEMS

[76] Inventor: Ralph C. Ohlbach, 417 Green Park Ct., Deerfield, Ill. 60015

[21] Appl. No.: 931,867

[22] Filed: Aug. 7, 1978

[51] Int. Cl.[2] ..... B65D 81/14; B65D 85/30

[52] U.S. Cl. ..... 206/328; 206/334; 220/410; 361/212

[58] Field of Search ..... 206/328, 334, 592, 444, 206/312; 229/37; 220/410, 118; 361/212

[56] References Cited

U.S. PATENT DOCUMENTS

| | | | |
|---|---|---|---|
| 1,504,292 | 8/1924 | Wickes | 220/410 |
| 3,774,757 | 11/1973 | Harris | 361/212 |
| 4,038,693 | 7/1977 | Huffine et al. | 206/444 |

*Primary Examiner*—William T. Dixson, Jr.
*Attorney, Agent, or Firm*—Kinzer, Plyer, Dorn & McEachran

[57] ABSTRACT

Shipping container especially for printed circuit boards, composed entirely of paper board coated on inside surfaces with conductive carbon black particles to prevent an outside static electricity charge from passing through the container.

5 Claims, 1 Drawing Figure

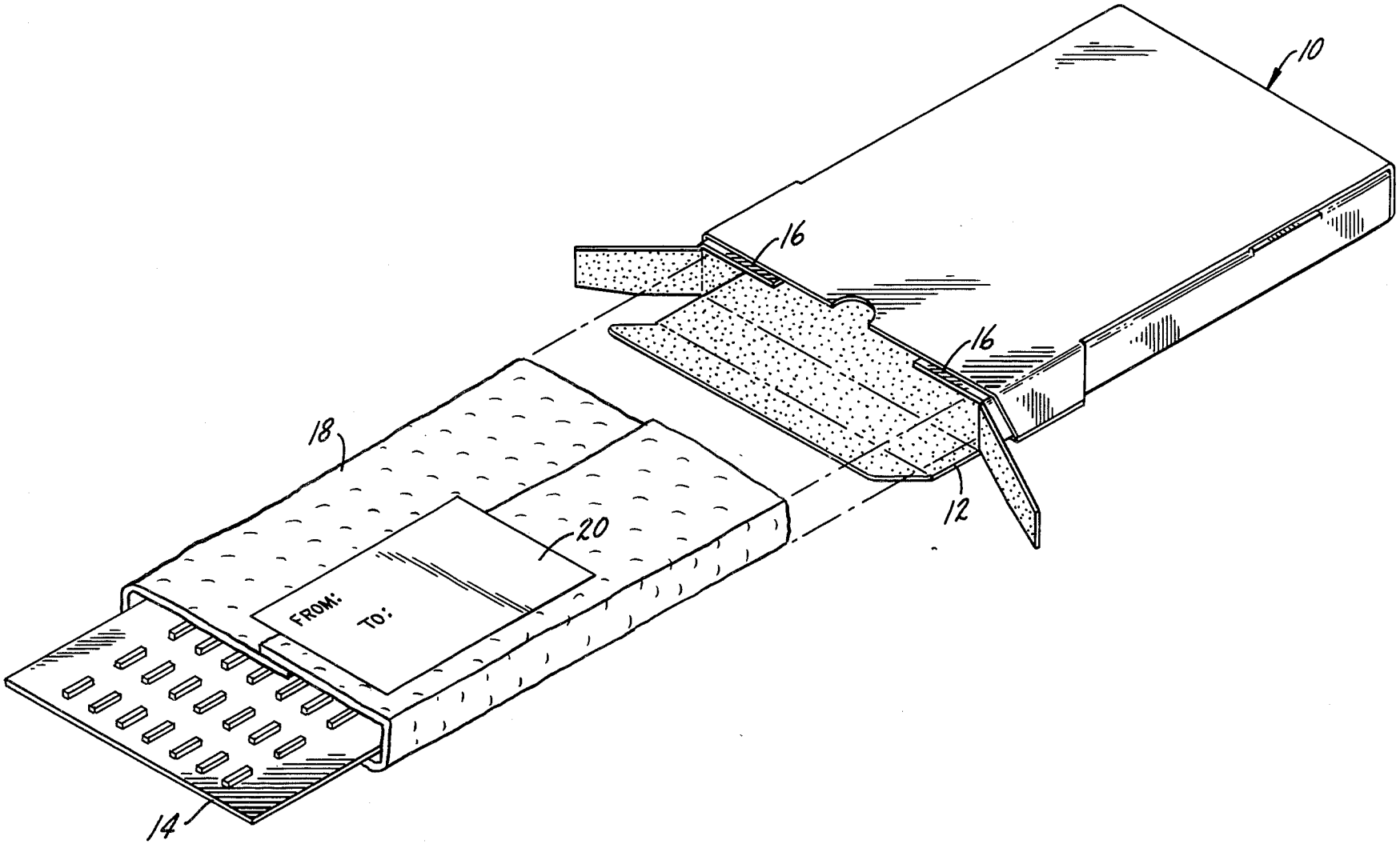
10
16
16
12
20
FROM:
TO:
18
14

SHIPPING CONTAINER FOR PRINTED CIRCUIT BOARDS AND OTHER ITEMS

This invention relates to the protection of printed circuit boards.

Static electricity has become a large problem for the electronics industry. With the advent of micro circuitry and the use of integrated circuits incorporating metal oxide semiconductors, complementary metal oxide semiconductors and field effect transistor silicon chips, packaging for shipping, storing and transferring printed circuit (PC) boards within production and service lines must offer protection against static electricity. Such integrated circuits are commonly referred to in the industry as electronic modules. Static electricity is originated in different ways but most commonly by movement of the person about the floor so that a charge is transferred from the person's hand to the circuitry, resulting in critical damage to one or more of the chips, which most of the time is not even known.

To date there is only a carbon impregnated plastic bag to protect the printed circuit boards from being damaged by large charges of static electricity. There is semi-clear polyethylene (bag or wrapping material) and also a "pink bubble" wrap material but each of these materials has proven to be only surface resistant up to twenty-five hundred volts per square inch, whereas the static charge can be much higher.

The use of flimsy plastic bags containing conductive carbon has proven to be costly and inadequate for handling, storing, inventory control and shipping of PC boards. Also the printed circuit board, during assembly at the manufacturing plant, has to be removed from the bag, some chips added at one station, reinserted in the bag, the bag slid to the next work station where more chips are added, and so on. A similar procedure is involved when the repairman services customer equipment. His service kit may contain a collection of printed circuit boards totalling a worth of thousands of dollars. He locates the defective PC board, removes a new PC board (bagged) from the kit, replaces the defective PC board, inserts the defective board in the bag, returns to his service point, packages the defective board in a shipping-carton and returns it to the manufacturer. The shipping carton is usually thrown away and this is also true of the carton used to return the replacement board to the manufacturer. During this procedure, as in the assembly process, a static charge may be inadvertently transferred to the board resulting in further damage to the circuitry and hence no one really knows the source of the defect in the first place. The repairman blames the manufacturer, the manufacturer blames the repairman and the customer doesn't know who to blame.

The magnitude of the problem is immense. One manufacturer in a local area assembles and releases over twenty thousand printed circuit boards per week and those boards, for the most part, are shipped out to the repairman for replacement purposes in the field or for shipment to further assembly plants, each PC board usually in an individual bag and box. Some may go into inventory at one place or another.

The impregnated plastic bag does safeguard the PC board against static charges of large voltage but it is expensive, it has a useful life of only about six handlings, and the bag does not safeguard the PC board against physical damage. Consequently the primary objects of the present invention are to expedite handling of a printed circuit board in service operation, to make possible superior protection of printed circuit boards, to save cost compared to the plastic bag impregnated with conductive carbon black particles, and to make possible a unique mode of inventory control.

IN THE DRAWING

The FIGURE is a perspective view of a container and parts to be contained therein, conforming to the present invention.

At the present time printed circuit boards for replacement are delivered to service points throughout the world. Each is placed in a carbon black-impregnated polyethylene bag; the bag is wrapped by packing material and then inserted in a box. Upon arrival at the destination, until used, the outer packing including the box and packing material are discarded, and the black bag containing the printed circuit board is placed on a shelf, in a service kit or otherwise carried around until installed as a replacement in the equipment. The defective printed circuit board is then inserted into the polyethylene (black) bag and taken back to the service department, repacked and sent back to the manufacturer.

Under the present invention, the printed circuit (PC) board is contained in a paper board box having a coating of conductive carbon black applied to interior surfaces opposite the outside surfaces of the container. The printed circuit board prior to insertion may be wrapped in a sheet of anti-static (electricity) plastic, such as polyethylene "bubble wrap". The box will have a label on one end designating the specific PC board. In the box will be a work order sheet which the repairman will fill out, showing the problems of the defective PC board he has replaced, and also a return mailing label.

The box ordinarily will not be opened until the PC board therein is to be installed as a replacement for the defective PC board.

When the new PC board is installed, the old one will be wrapped in the same wrapping, inserted into the same box with the work order sheet filled out by the service man. The inner address label will be applied over the old label and the box is ready for return mailing to the manufacturer.

This system will reduce the material costs, will eliminate the man hours for handling and packaging and will normally be mailed at a lower postage rate. These advantages constitute additional objects of the present invention.

Referring to the drawing, the box or container 10 is of one-piece paper board having six walls, including an openable end wall or flap 12 defining an interior cavity for insertion therein of a PC board 14 constituting, for example, a replacement board for a defective PC board. To achieve the desired strength for protecting the PC board, the box for minimum strength in most instances will be either the grade known in the paper industry as E-flute corrugated board (double faced) or the grade of board known as folding carton board.

The paper surfaces constituting the inside of the box 10 are coated with a coating of conductive carbon black denoted by stippling. The coating may be applied at the plant where the board for the box is die cut and scored. The coating is applied as a printing process. It should be noted in this regard that an extra flap or flap folded on itself, if used, need not be coated on all surfaces which will be inside the box since any static charge will be stopped by the coating on one inside flap surface which is enough. Thus, both sides of the strengthing flap 16 inside the box need not be coated. In effect the conductive coating is applied to inside paper surfaces opposite corresponding outside paper surfaces, such that when the box is opened out or flat the side constituting the inside of the container is uniformly covered by carbon black conductive particles incorporated in a printing ink.

The coating vehicle may be composed of seventy pounds of water and thirty pounds of any preferred printing ink varnish containing twelve and one half pounds of dispersed conductive carbon black particles. This calculates out to one and one-quarter pounds of conductive carbon black per gallon. The coating may be roller coated or applied in any other convenient manner. A coating weight corresponding to one hundred square feet per pound (above formula) is capable of sustaining a charge of about fifty thousand volts per square inch.

The printing ink varnish is preferred as the principal vehicle for the carbon black particles because it represents an inexpensive, paper adherent, easily dried tacky (adhesive) material for effectively holding in dispersed form the carbon black particles and itself being adherent to the paper to anchor the carbon black particles. Any equivalent tacky vehicle may be used, that is, the varnish may be replaced by an acrylic or any other liquid vehicle employed in paper board printing inks capable of dispersing carbon black particles. Also, as noted, corrugated board (double faced) may be used and in most instances will be preferred.

Preferably the printed circuit board 14 is protectively wrapped in a cushioning polyethylene "pink bubble" wrapper 18 before insertion. This wrapper may be part of the container as supplied and can be used to wrap the defective PC board which is replaced.

Also, the box as supplied will contain a mailing label 20 having an obverse surface adherable to the box. The label 20 will be addressed to the manufacturer and may be applied over any previous mailing label by the repairman incidental to returning to the manufacturer the defective PC board wrapped in the re-useable wrapper 18. The manufacturer responsible for the defective PC board will re-use the box 10 and wrapper 18 the same way, returning to the service office a new, replacement PC board.

By affixing a label or other suitable identification mark to one end or side of the box, the type of PC board may be denoted, so that at all times the same durable box 10 may serve repeatedly for safe transmittal to and from the service point PC boards of one kind.

While the invention has been disclosed in terms of protecting PC boards the container may be employed to safeguard other items such as expensive lenses where a static charge can attract and hold dirt particles likely to scratch the lens.

The wrapping material 18 will be wrapped around all edges of the wrapped item but this is not shown in the drawing.

The coating, composed of water and the ink vehicle, is an emulsion of course and the conductive particle preference is VULCAN XC-72LR conductive carbon black particles supplied by Cabot Corporation: 98.5% by weight fixed carbon (1.5% volatiles), 19 millimicrons mean diameter, log volume resistivity (ohms-cm) in the range of about 2.3 to 6.

I claim:

1. A paper board shipping container having at least an openable end for receiving a printed circuit board or other electronic article to be protected against a charge of static electricity, erected from folding carton board or corrugated board at least of the strength of E-flute to present six walls defining an interior cavity for insertion of said article, all inside paper surfaces opposite outside paper surfaces of the container board being coated with particles of conductive carbon black contained in a printing ink vehicle and of such concentration as to prevent a charge of static electricity originating outside the container from passing through the container, and said container containing an electronic component or module unit sensitive to a charge of static electricity.

2. A container according to claim 1 containing a sheet of anti-static wrapping material for wrapping the contained electronic article as well as a defective electronic article to be replaced thereby, the printing ink vehicle being a varnish or an acrylic.

3. A container according to claim 1 or 2 combined with a mailing label adherent to the container for returning to a point of service the replaced defective electronic article.

4. A paper board shipping container having at least an openable end for receiving a printed circuit board or other electronic article to be protected against a charge of static electricity, constructed from folding carton board or corrugated board to present five walls defining an interior cavity for insertion of said article, and a sixth wall for closing said interior cavity, all inside paper surfaces opposite outside paper surfaces of the five walls of the container board, and said sixth wall as well, being coated with particles of conductive carbon black contained in a printing ink vehicle and of such concentration as to prevent a charge of static electricity originating outside the container from passing through the container, and said container containing an electronic component or module unit sensitive to a charge of static electricity.

5. A container according to claim 4 containing a sheet of anti-static wrapping material for wrapping the contained electronic article as well as a defective electronic article to be replaced thereby, the printing ink vehicle being a varnish or an acrylic.

* * * * *